US006793597B2

(12) United States Patent
Awan

(10) Patent No.: US 6,793,597 B2
(45) Date of Patent: Sep. 21, 2004

(54) MACHINE STITCHED SOCCER BALLS WITH FLOATING BLADDER

(76) Inventor: Jarrar Hussain Awan, Shatab Garh Sialkot, Sialkot, Punjab 53110 (PK)

( * ) Notice: Subject to any disclaimer, the term of this patent is extended or adjusted under 35 U.S.C. 154(b) by 0 days.

(21) Appl. No.: 10/241,715

(22) Filed: Sep. 12, 2002

(65) Prior Publication Data

US 2004/0053717 A1 Mar. 18, 2004

(51) Int. Cl.[7] ..... A63B 41/10
(52) U.S. Cl. ..... 473/605; 473/594
(58) Field of Search ..... 473/603, 604, 473/605, 594, 599, 609

(56) References Cited

U.S. PATENT DOCUMENTS 4,191,375 A 3/1980 Uruba et al.
4,830,373 A 5/1989 Dehnert et al.
5,542,662 A * 8/1996 Kouzai et al. ..... 473/605
5,762,573 A * 6/1998 Kennedy et al. ..... 473/604
5,772,545 A 6/1998 Ou
6,220,979 B1 4/2001 Chan
6,390,941 B1 5/2002 Ou
6,413,177 B1 * 7/2002 Guenther et al. ..... 473/605
6,517,471 B2 * 2/2003 Chen ..... 473/604
6,645,100 B2 * 11/2003 Guenther et al. ..... 473/605
6,656,067 B2 * 12/2003 Ou ..... 473/605

* cited by examiner

*Primary Examiner*—Steven Wong
(74) *Attorney, Agent, or Firm*—Richard C. Litman

(57) ABSTRACT

An improved soccer ball having a floating bladder and the method of manufacturing same. The soccer ball comprises a spherical rubber bladder and an outer cover of machine stitched multiple hexagonal and pentagonal pieces to form an outer cover for inserting the bladder therein. In between the bladder and the outer cover is a vulcanized web of thread and adhesive. This web-like material supports the outer panel coating an resists stress applied to the ball. The outer surface of the bladder is also coated with the silicon-releasing chemical before winding. The resulting ball is placed in a vulcanizing mold. A floating bladder in vulcanized web separated by silicone release material is the result.

6 Claims, 10 Drawing Sheets

MACHINE STITCHED SOCCER BALLS WITH FLOATING BLADDER

BACKGROUND OF THE INVENTION

1. Field of the Invention

The present invention relates to sports balls. More particularly, the present invention relates to a soccer ball and its method of construction which has a floating bladder covered by an intermediate wound vulcanized web.

2. Description of the Related Art

It is known to provide a sports ball such as a soccer ball with an inner bladder having a winding of threads forming a layer thereon, an outer layer being either affixed to the winding layer or separately provided with the bladder, and winding being inserted and affixed at a valve stem to a presewn outer layer such as leather. Additional layers of material such as cotton cloth or sponge rubber may be provided within the outer layer to impart softness to the ball and maintain roundness. It is known to provide such a ball with an adhesive coated winding over the bladder which attaches to the outer side of the bladder to control roundness and impart strength to the ball. The adhesive coated winding, when vulcanized in a mold forms a web adhered to the bladder to improve strength and roundness of the bladder once inflated within the cover. It would be desirable to provide a soccer ball having such a web wherein the bladder is free to float within the web to improve roundness when the ball is subjected to forces during sports play.

U.S. Pat. No. 4,191,375, issued Mar. 4, 1980, to Uruba et al., describes a game ball having an inner bladder and a layer of yarn wound thereabout. The yarn layer is formed by a first strand of synthetic material and a second strand of neutral material. As these strands are being simultaneously wound on the inner bladder, an adhesive is applied to the strand of synthetic material. A cover is then applied to form the sports ball.

U.S. Pat. No. 4,830,373, to Dehnert et al. describes a soccer ball having a cover of alternating star-shaped and hexagonal panels stitched at their adjacent edges. The soccer ball includes an inflatable, floating bladder comprising two-ply butyl within a thread-formed carcass.

U.S. Pat. Nos. 5,772,545 and 6,390,941 B1 to Ou describe a sports ball and manufacturing method which makes use of a strengthened nylon thread, overlapping each other to form a web layer which permanently embraces and adheres to the bladder. The web layer supports the ball cover.

U.S. Pat. No. 6,039,662 issued Mar. 21, 2000 to Chan describes a method of making a machine stitched soccer ball.

U.S. Pat. No. 6,220,979 B1, issued Apr. 24, 2001, to Chan, describes an inflatable machine-stitched sports ball and the method of manufacturing the same.

None of the above inventions and patents, taken either singularly or in combination, is seen to describe the instant invention as claimed. Thus a machine stitched soccer ball with floating bladder solving the aforementioned problems is desired.

SUMMARY OF THE INVENTION

The present invention is an improved sports or soccer ball having a floating bladder and the method of manufacturing same. The soccer ball comprises a spherical rubber bladder having a valve hole into which a valve stem is introduced for inflating the bladder, and an outer cover of machine stitched multiple hexagonal and pentagonal pieces to form an outer cover for inserting the bladder therein. In between the bladder and the outer cover is a vulcanized web of thread and adhesive.

During the manufacturing process, a suitable elastic yarn is precoated with a silicon-releasing chemical, dipped in a suitable adhesive, and wound tightly around the inflated bladder causing the formation of a web-like material which firmly embraces the bladder. This web-like material supports the outer panel coating and resists stress applied to the ball. The outer surface of the bladder is also coated with the silicon-releasing chemical before winding. The resulting ball is placed in a vulcanizing mold and heated to about 150 degrees Centigrade, enabling the silicon-releasing chemical to melt while the adhesive-thread web is cured to form a discrete integral element. Foam and cloth layers may also be introduced. The silicon released forms a layer separating the inner bladder from the web, forming an independent intermediary layer, allowing the bladder to be suspended or maintained in a floating status inside the ball relative to the web. Because of the floating state of the bladder, stress applied to the ball is evenly absorbed by all the various layers, and, consequently, the ball may be built relatively light while remaining durable and soft for heading, easily withstanding impacts and remaining perfectly round for true directional flight.

Accordingly, it is a principal object of the invention to provide a machine stitched soccer ball and its method of making having a floating bladder.

It is another object of the invention to provide a soccer ball as above having a supporting elastic web located between the bladder and the cover for supporting the cover during use.

It is a further object of the invention to provide a soccer ball as above which remains round during play.

Still another object of the invention is to provide a soccer ball as above having a release agent between the elastic web and the bladder providing floating characteristics to the bladder within the web.

Yet another object of the invention is to provide a method of producing a soccer ball as above by forming the elastic web with thread which has been dipped in a release agent and an adhesive which, upon vulcanization on the bladder within a molds forms a web with a the bladder floating relative thereto by means of the release agent present between the web and the bladder.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Usually, sports balls such as soccer balls are made by either hand stitching using different methods of manufacturing which employs laminating cloth(dipped in Latex) to Polyvinyl chloride(PVC) or polyurethane(PU) or leather and cut into predetermined panels which are hand stitched together. This is labor intensive.

Another method employs machine stitching, where a web of Nylon is overlapped onto the sports ball bladder and adhered to the bladder and then heated in a mold to form a "bladder ball" which is then inserted into the machine stitched ball cover.

The first method is time consuming and for mass production is not feasible. The second method is useful for mass production, but the ball is not 100% round and the impact of stress is not usually passed through the outer cover of the soccer ball evenly and the machine sewing thread is not strong enough to take the stress, resulting in the outer cover being torn apart. The softness of the ball is inferior.

The inventive ball is machine sewn, but the presence of a floating bladder helps distribute impact stresses, resulting in less stress on thread and a softer ball for retaining roundness and lessening stress on player doing headers. The following steps are taken to construct this inventive ball.

a) Inflating a rubber ball bladder having a valve stem and coating the bladder with silicone releasing material;

b) Impregnating yarn through specially made HRH adhesive containing powdered silicon;

c) Winding the adhesive coated yarn evenly on the pretreated bladder to form a web layer overlapping with each other;

d) Vulcanizing the ball bladder as wound so that during the process the web is vulcanized to make a shell and the bladder is separable from the web;

e) Cutting the panels of the balls to hexagon and pentagon predetermined shape;

f) Sewing by machine the hexagon, pentagon panels edge to edge to form outer cover of a soccer ball which has a valve hole in one of the panels. A last few panels are not sewn to form a bladder inlet portion;

g) Inserting the bladder ball into the ball cover after turning the cover right side out through the inlet portion;

h) Aligning and gluing the valve stem of bladder ball with valve hole of outer cover;

i) Inflating the ball bladder to make sure the inner core is properly aligned with ball cover; and j) Hand stitching the final inlet portion to form the soccer ball.

The strengthened thread is either Nylon polyester/Viscous (P.V.) or polyester-cotton blend (P.C.). The panels of the ball cover are made of a thin layer of leather which is adhered to a padded foam layer. The panels may be made of synthetic leather. The balls may be made of foaming polymer such as polyurethane or polyvinyl chloride(PVC). Also, layers of cotton/polyester may be included in the construction.

Figure 1:
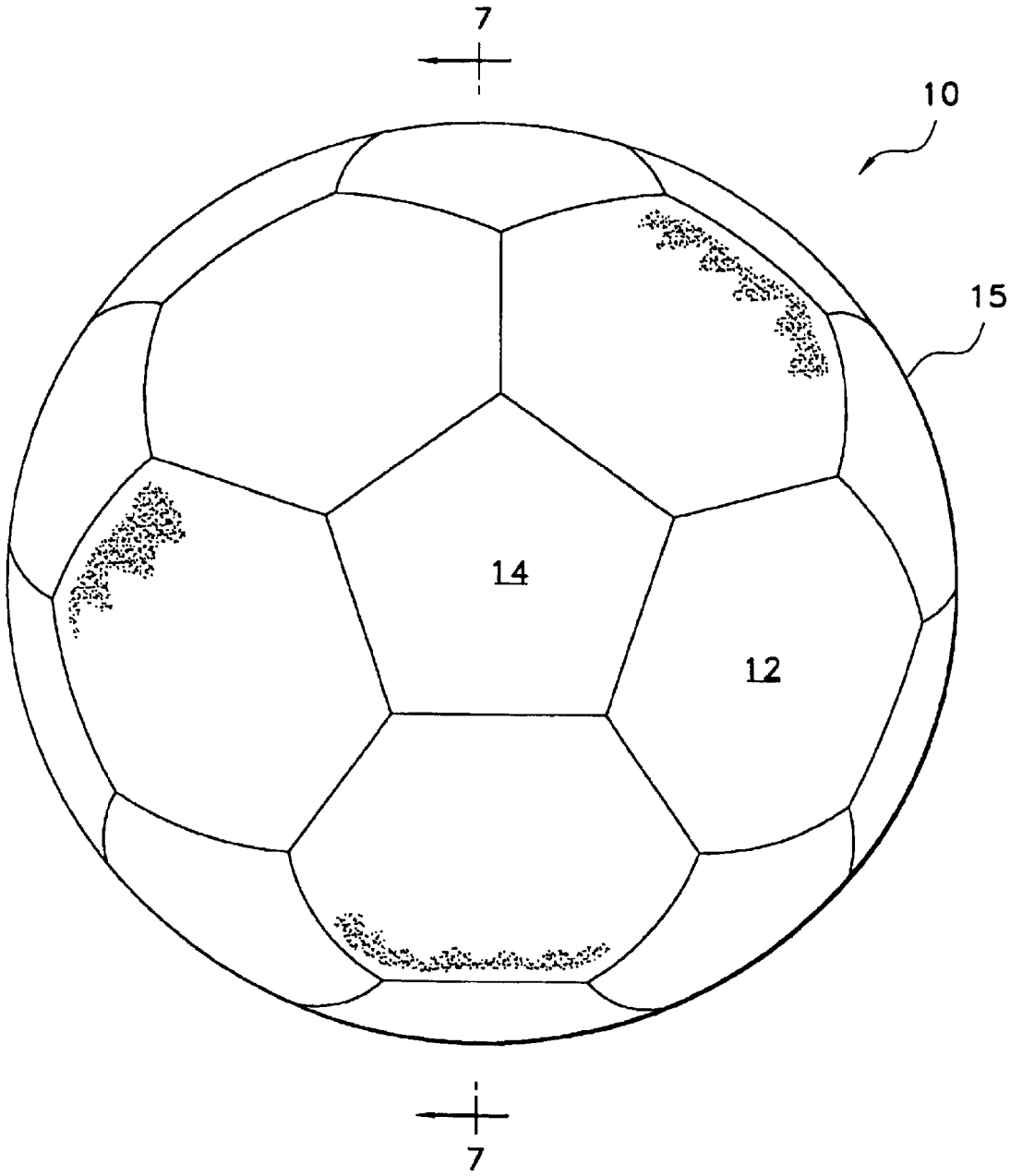
FIG. 1 is a perspective view of a machine stitched soccer ball with floating bladder according to the present invention.

Referring to the Figures, as shown in FIG. 1, there is shown a machine-sewn, floating bladder soccer ball 10 having pentagon skin portions 12 and hexagon skin portions 14 machine stitched to form the ball outer skin 15.

Figure 2:
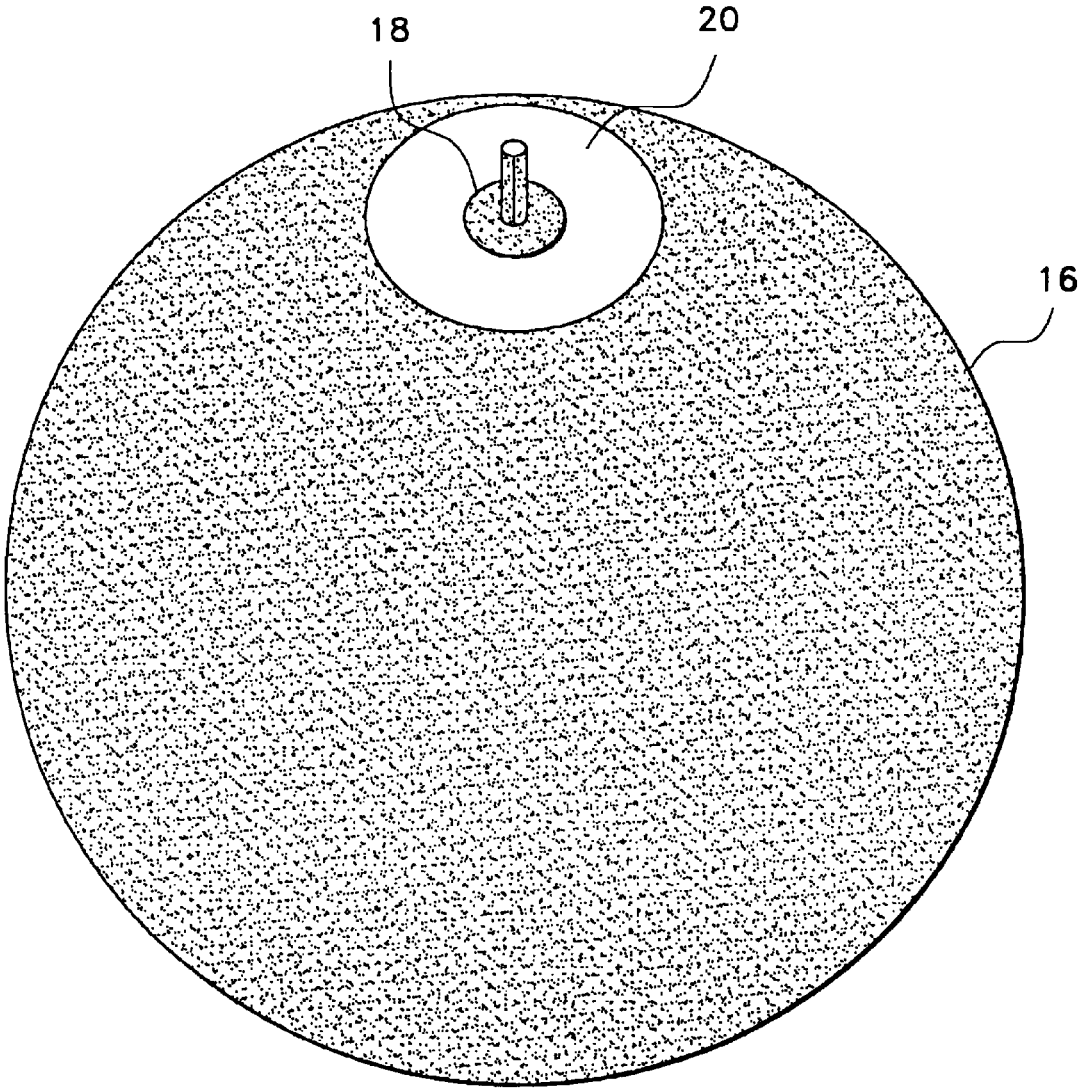
FIG. 2 is a butyl bladder of the soccer ball of FIG. 1.
Figure 3:
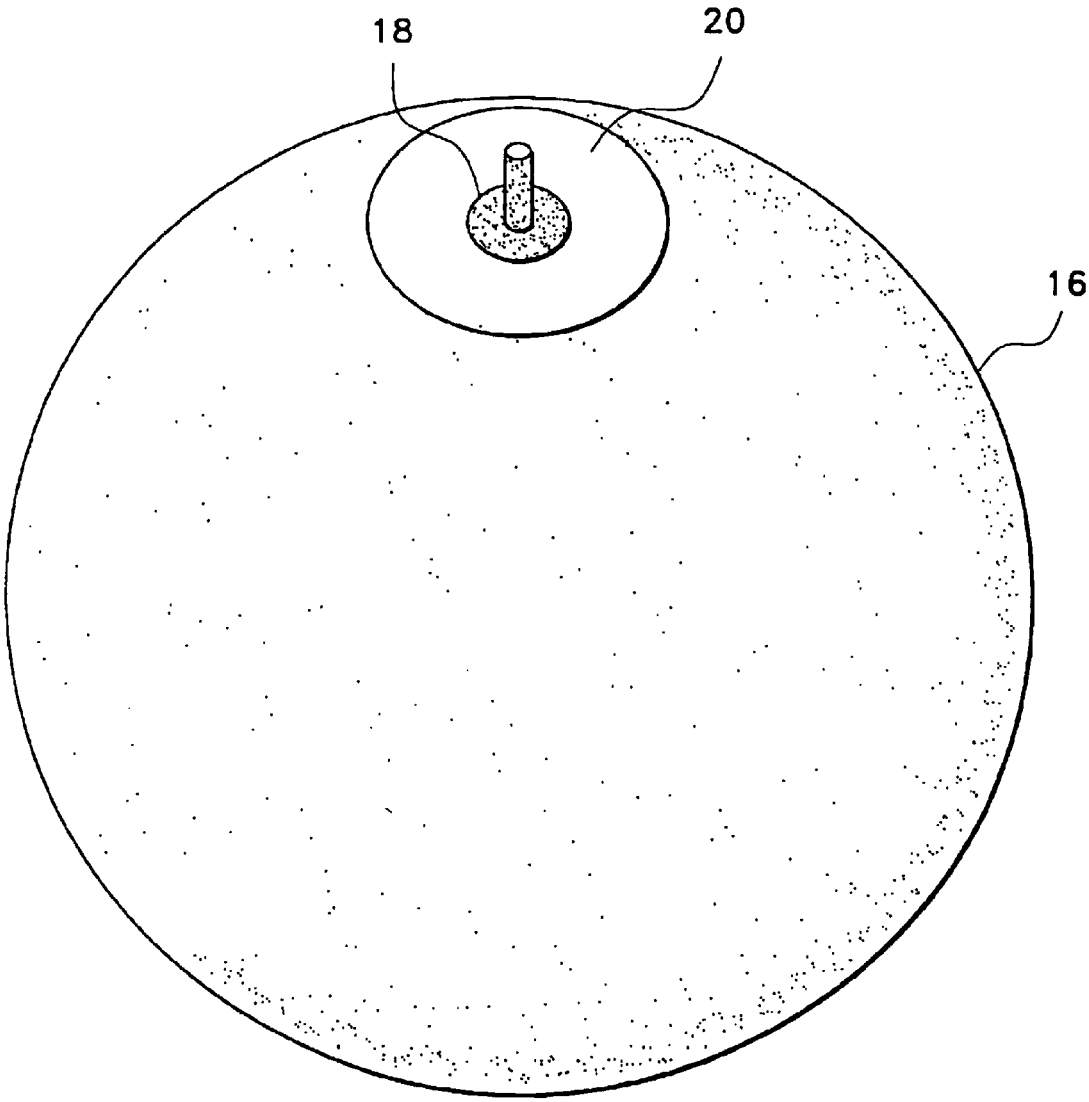
FIG. 3 is a butyl bladder as in FIG. 2 with silicone covering.

As shown in FIGS. 2 and 3, there is shown the inflated butyl bladder 16 having air valve 18 in support 20, the bladder 16 being shown without silicon releasing chemical covering in FIG. 2 and with silicon releasing chemical coating in FIG. 3.

Figure 4:
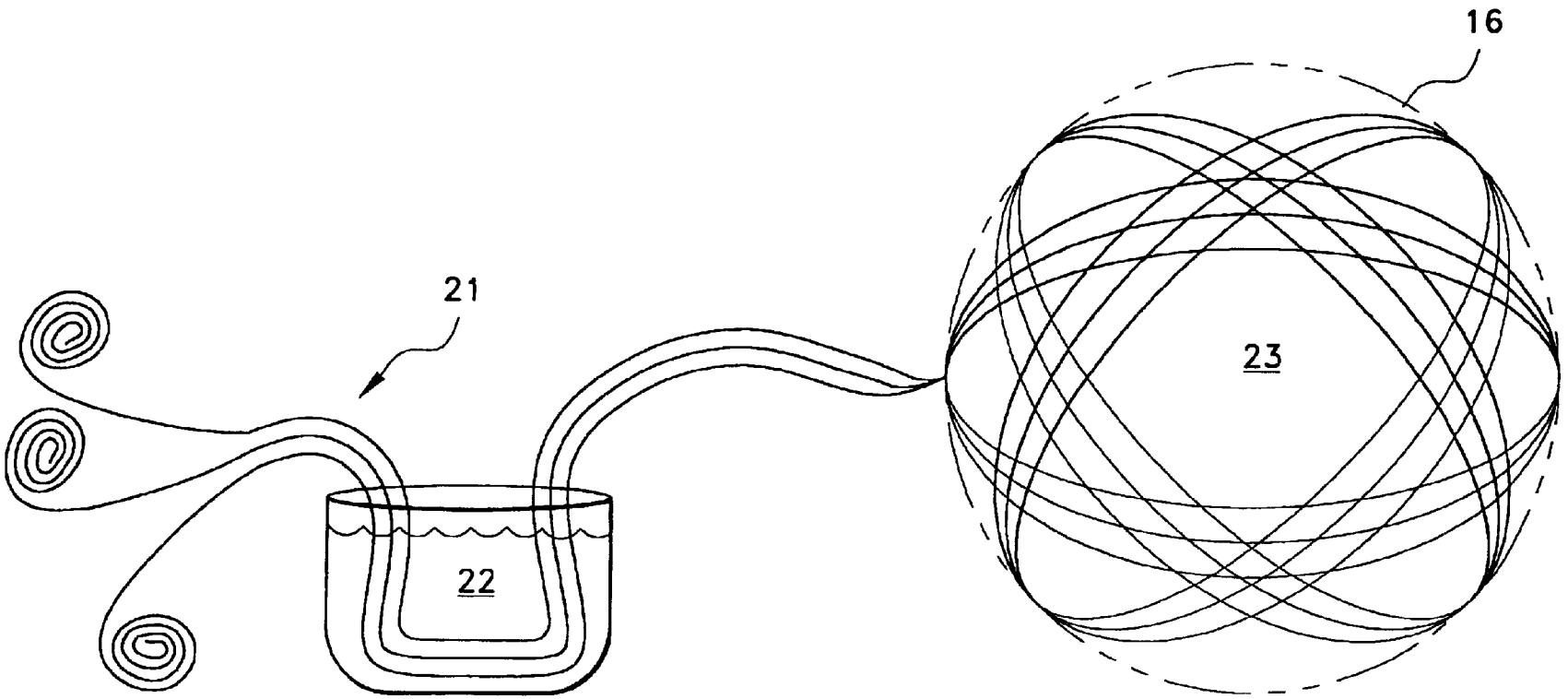
FIG. 4 is a butyl bladder as in FIG. 2 wrapped with silicone dipped and then adhesive dipped yarn.

As seen in FIG. 4, silicon-releasing chemical coated yarn 21 is dipped into adhesive 22 and wound on bladder 16 to form adhesive-yarn web 23.

Figure 5:
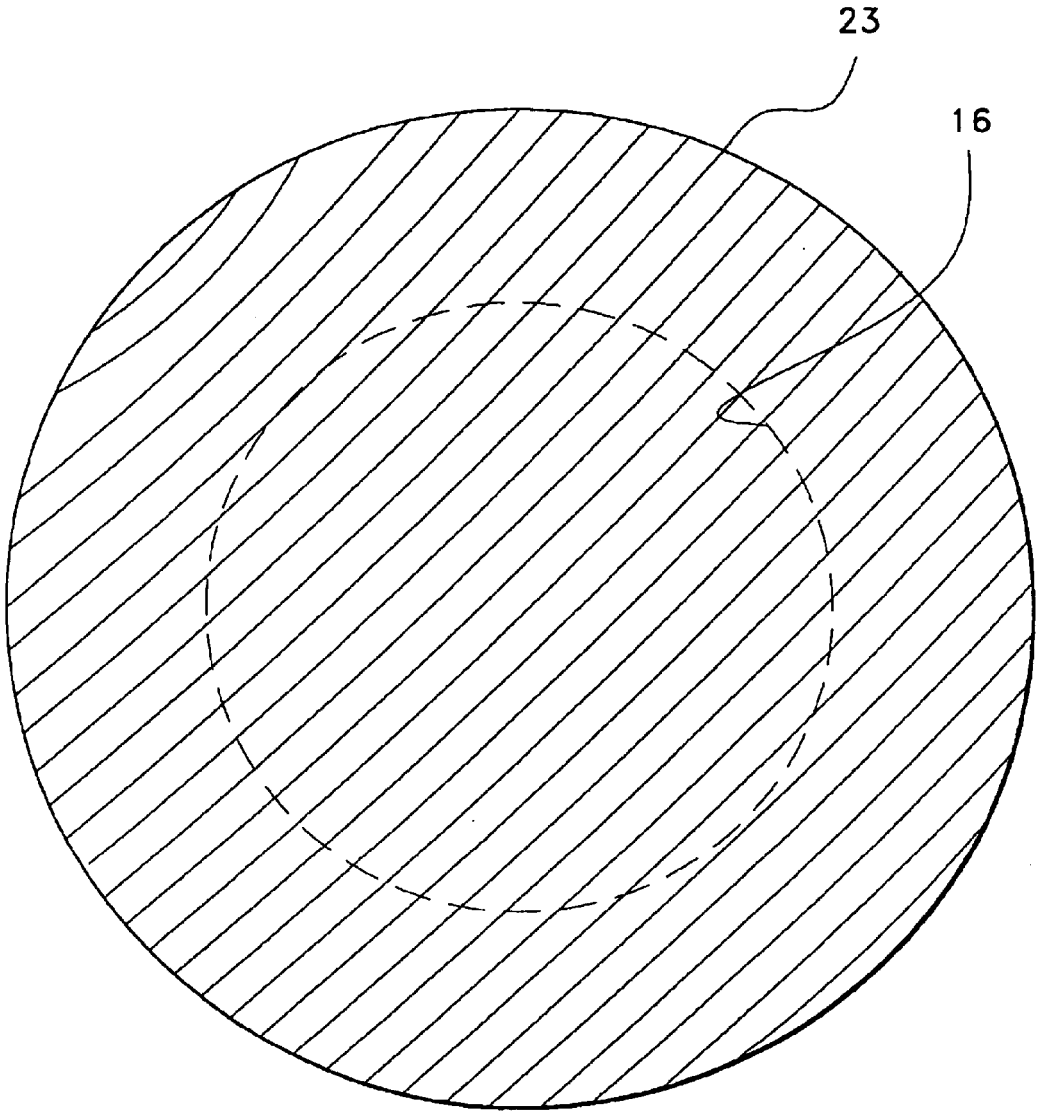
FIG. 5 is a representation of the product of FIG. 4 after vulcanization.

FIG. 5 illustrates the bladder 16 as covered by adhesive-yarn web 23 and vulcanized, bladder 16 being partially deflated to show separation therebetween.

Figure 6:
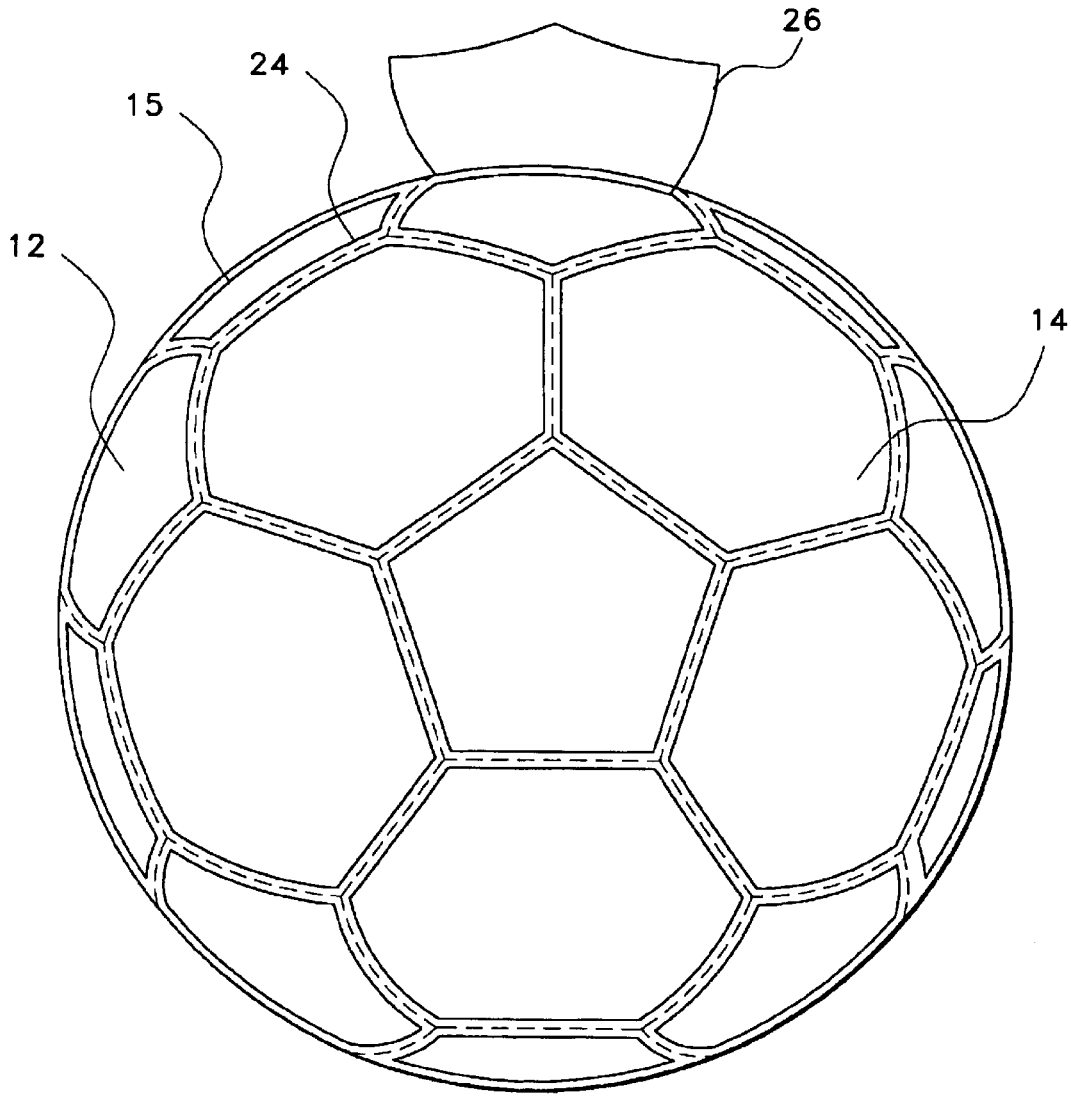

As seen in FIG. 6, the outer skin 15 of the soccer ball is sewn by machine or hand to form the inner side 24 of outer skin 15 formed by stitching pentagon pieces and hexagon pieces together as illustrated, outer skin closing patch 26 remaining open to reverse the skin to the desired configuration of skin or cover 15.

Figure 7:
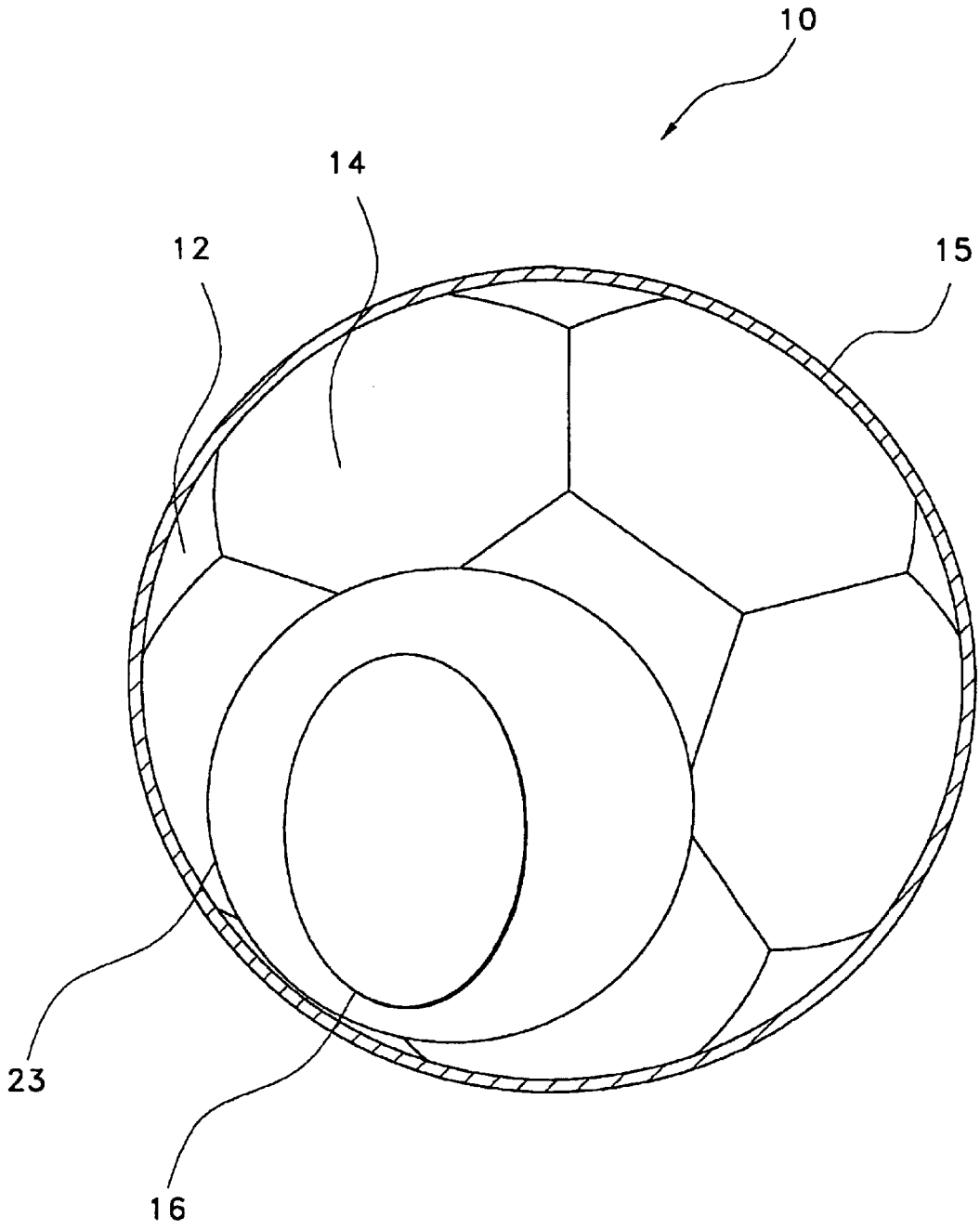
FIG. 7 is a sectional view of the ball of FIG. 1 taken along line 7—7.

As seen in FIG. 7, there is shown a cross-sectional view of the soccer ball with bladder 16 within web 23 as inserted within ball outer skin 15 (air valve not shown).

Figure 8:
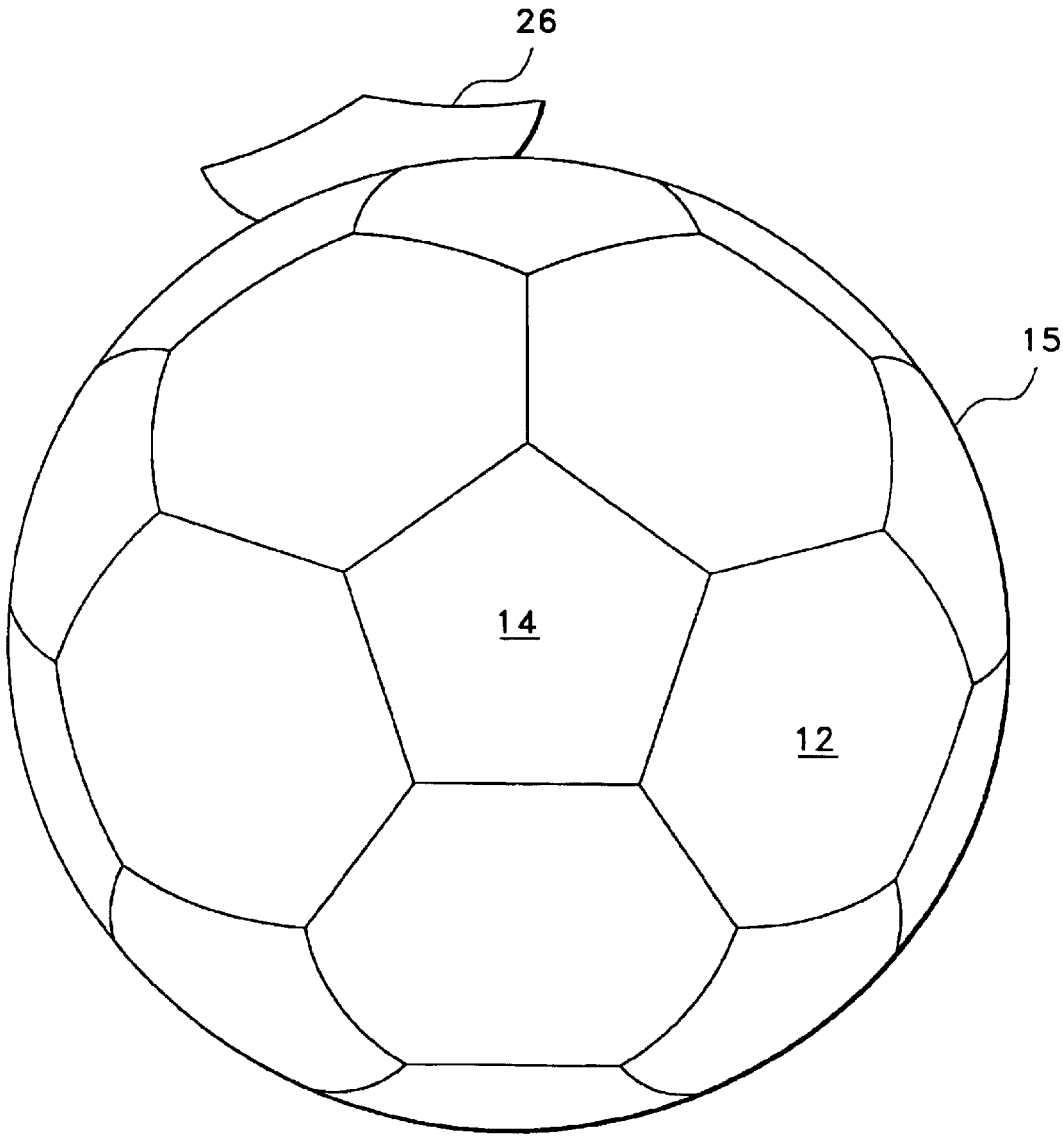
FIG. 8 is a view of the ball of FIG. 6 turned outward with opening.

FIG. 8 illustrates the outer skin assembly of FIG. 7 turned right side out to form the final configuration of the skin 15.

Figure 9:
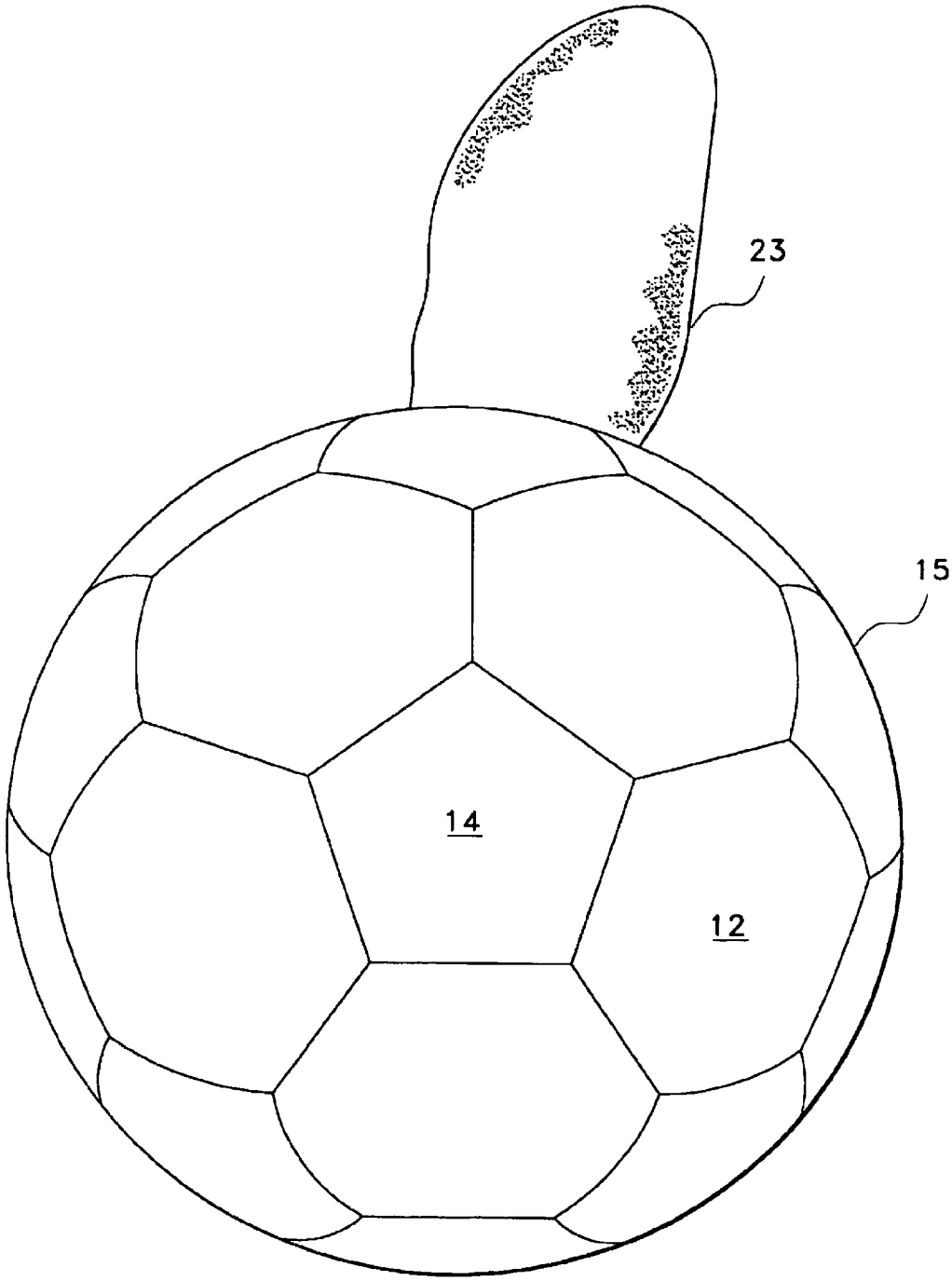
FIG. 9 is a view of the ball outer skin as in FIG. 8 during insertion of butyl bladder and vulcanized web.
Figure 10:
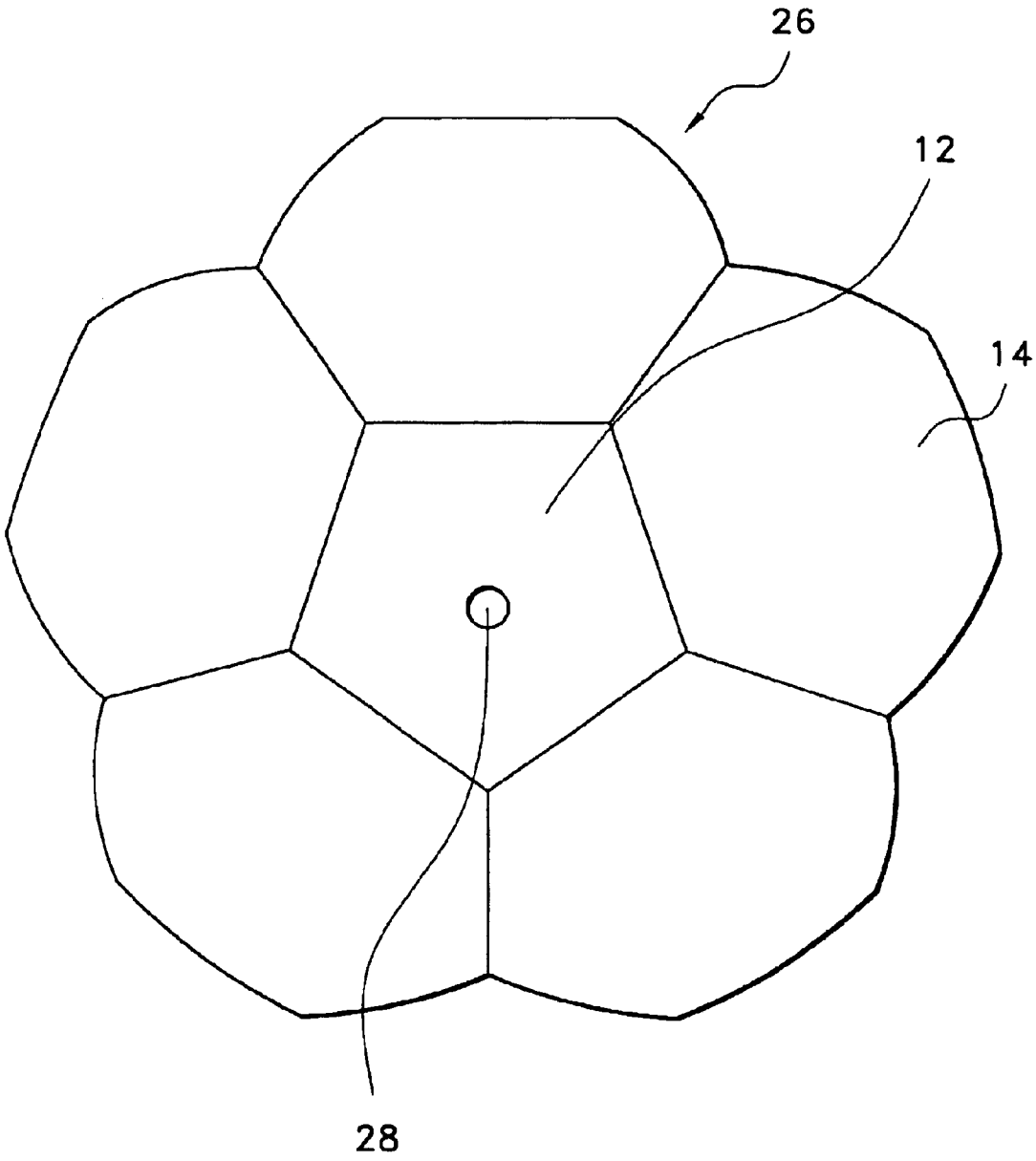
FIG. 10 is a view of ball closing skin with bladder valve hole.

Referring to FIG. 9 there is shown the outer skin of FIG. 9 with bladder-containing web 23 being inserted within skin 15. The FIG. 10 illustrates one form of closing patch 26 having valve hole 28 for insertion of air valve 18. Once the bladder and web are inserted into the skin 15, and the air valve 18 correctly oriented, the closing patch 26 is sewn closed.

The yarn employed in wrapping the bladder is preferably nylon or polyester, cotton, or polyester viscous. The preferred thickness is about 210 d. The length of yarn is 2000 meters. There are preferably three threads of 210 d thickness dipped through adhesive and wound on the bladder resulting in a total thickness of winding of about 1 mm and a total weight of about 25 gm.

The adhesive is designated HRH adhesive which is compounded of rubber, Hi Rescional, and Hi Silica. The rubber is smoke rubber. Hi Rescional is formaldehyde resin from BAYER designated and A-50 which basically functions as a cross linking and bonding agent between rubber and textile. Hi Silica is ground powder of silicate which is used for strengthening the thread. As all these items are used to prepare the adhesive, it is called HRH adhesive.

Nylon is referred to as nylon yarn, whereas P.V. is referred to Polyester/Viscous thread Yarn and P.C. is referred to polyester cotton blended thread or yarn. The chemical or silicone agent used to coat the bladder is zinc stearate, which melts during the vulcanization and departs the web and bladder resulting in the release silicone layer allowing the bladder to float relative to the vulcanized adhesive web.

The outer skin may be of synthetic leather outer coated layer of either kid grain, smooth dull or shiny. An inner layer may be cloth lining or synthetic backing. Additional layers of cotton, foam rubber, or similar materials may be included between the adhesive web and the outer skin.

Once the machine has stitched the inside panels of the outer skin and before sewing the last few panels, the bladder is fitted inside. The ball bladder is made of rubber/Butyl and a web layer is wound around the outer surface of the bladder. The bladder is precoated with silicone releasing chemical.

The web layers include the yarn overlapped with each other passing through specially formulated HRH adhesive containing ground silicate to form the web layer to fully embrace the bladder ball for supporting the ball cover and resisting the stress and impact force exacted upon the sports ball. The bladder ball with web impregnated with HRH adhesive is put into a vulcanizing mold and heated to 150 degrees Centigrade in the mold to vulcanize the bladder ball web, during the process of vulcanizing the release agent/silicone melts, which prevents adherence of the bladder to the web. The resulting web is vulcanized as an independent intermediate layer between the bladder and the skin and stress is evenly absorbed by all three parts of the inventive sports ball. The ball is strong enough to take the impact and stress of the game. It is durable and softer for heading and 100% round for better direction and flight.

The inventive soccer ball and its method of making are considered an improvement over that of U.S. Pat. Nos. 5,772,545 and 6,390,941 B1 to Ou the disclosures of which are hereby incorporated by reference, the Ou soccer balls having a bound bladder as opposed to the floating bladder of the present invention.

It is to be understood that the present invention is not limited to the embodiments described above, but encompass any and all embodiments within the scope of the following claims.

I claim:

1. A sports bail comprising:

a ball cover having a valve hole defined therein and a plurality of panels connected edge to edge by machine sewing to form a spherical shape, each of said panels having a polygonal shape and being made of a material selected from the group consisting of leather and synthetic leather;

a spherical rubber bladder disposed inside said ball cover, said bladder having an outer surface coated with a silicon release layer;

a valve stem mounted on said bladder and extending through the valve hole of said ball cover;

a hardened web layer surrounding and separated from said bladder coated with the silicon release layer, such that the bladder is allowed to float inside the ball cover relative to said hardened web layer said hardened web layer being formed from strengthened yarn impregnated with an adhesive that is wound evenly around the bladder precoated with a silicon releasing agent and subjected to vulcanization in a mold;

whereby the silicon releasing agent melts during the vulcanization to coat the outer surface of the bladder with the silicon release layer to prevent adherence of the bladder to the hardened web layer.

2. The sports ball according to claim 1, wherein the panels of said ball cover are made of synthetic leather having an outer coating layer, an inner lining layer, and an intermediate layer integrally formed between the outer coating layer and the inner lining layer.

3. The sports ball according to claim 1, wherein the panels of said ball cover are made of a thin layer of natural leather having adhered thereto a layer of padded form.

4. The sports ball according to claim 1, wherein said bladder is made of butyl rubber.

5. The sports ball according to claim 1, wherein the adhesive used to form said hardened web layer is compounded of rubber, a formaldehyde resin and silicate powder.

6. The sports ball according to claim 1, wherein the strengthened yarn used to form said hardened web layer is made of a material selected from the group consisting of nylon, a polyester and a polyester/cotton blend.

* * * * *